US006267651B1

(12) United States Patent
Kordonski et al.

(10) Patent No.: US 6,267,651 B1
(45) Date of Patent: Jul. 31, 2001

(54) MAGNETIC WIPER

(75) Inventors: William Kordonski, Webster, NY (US); Gennadi Gorodkin, Minak (BY); Stephen Hogan, Rush; Arpad Sekeres, Rochester, both of NY (US)

(73) Assignee: QED Technologies, Inc., Rochester, NY (US)

( * ) Notice: Subject to any disclaimer, the term of this patent is extended or adjusted under 35 U.S.C. 154(b) by 0 days.

(21) Appl. No.: 09/480,306

(22) Filed: Jan. 10, 2000

(51) Int. Cl.[7] ..... B24B 49/00
(52) U.S. Cl. ..... 451/113; 451/36; 451/43
(58) Field of Search ..... 451/36, 60, 37, 451/43, 87, 74, 106, 93, 78, 113, 446

(56) References Cited

U.S. PATENT DOCUMENTS 5,577,948 * 11/1996 Kordonsky et al. ..... 451/113 X
5,616,066 4/1997 Jacobs et al. .
5,775,976 * 7/1998 Kremen et al. ..... 451/36
5,795,212 8/1998 Jacobs et al. .
5,839,944 * 11/1998 Jacobs et al. ..... 451/36 X
5,951,369 9/1999 Kordonski et al. .
6,036,580 * 3/2000 Igelshteyn et al. ..... 451/36

* cited by examiner

*Primary Examiner*—Derris H. Banks
*Assistant Examiner*—Anthony Ojini
(74) *Attorney, Agent, or Firm*—Harris Beach, LLP

(57) ABSTRACT

A magnetic wiper for removing magnetorheological fluid from a carrier surface includes a horseshoe magnet having north and south polepieces elongated in a first direction orthogonal to a second direction of magnetic flux in the magnet. The polepieces are generally parallel at their free ends in the first direction and are preferably arcuate such that the inner polepiece forms a trough for receiving magnetorheological fluid removed from the carrier surface and conveying it to an exit tube. The free ends are shaped to conform closely to the shape of the carrier surface, forming a narrow gap therebetween containing a magnetic fringing field extending beyond the free ends. Magnetorheological fluid conveyed into the gap by the carrier surface is magnetically stiffened to a very stiff paste which is retained in the gap by the fringing field, forming a dynamic liquid seal such that additional magnetorheological fluid carried by the carrier surface is wiped away from the surface and into the trough formed by the inner polepiece. Thus, the magnet forms an effective remover of magnetorheological fluid from the carrier surface without any mechanical contact with the surface.

16 Claims, 8 Drawing Sheets

MAGNETIC WIPER

DESCRIPTION

Figure 1:
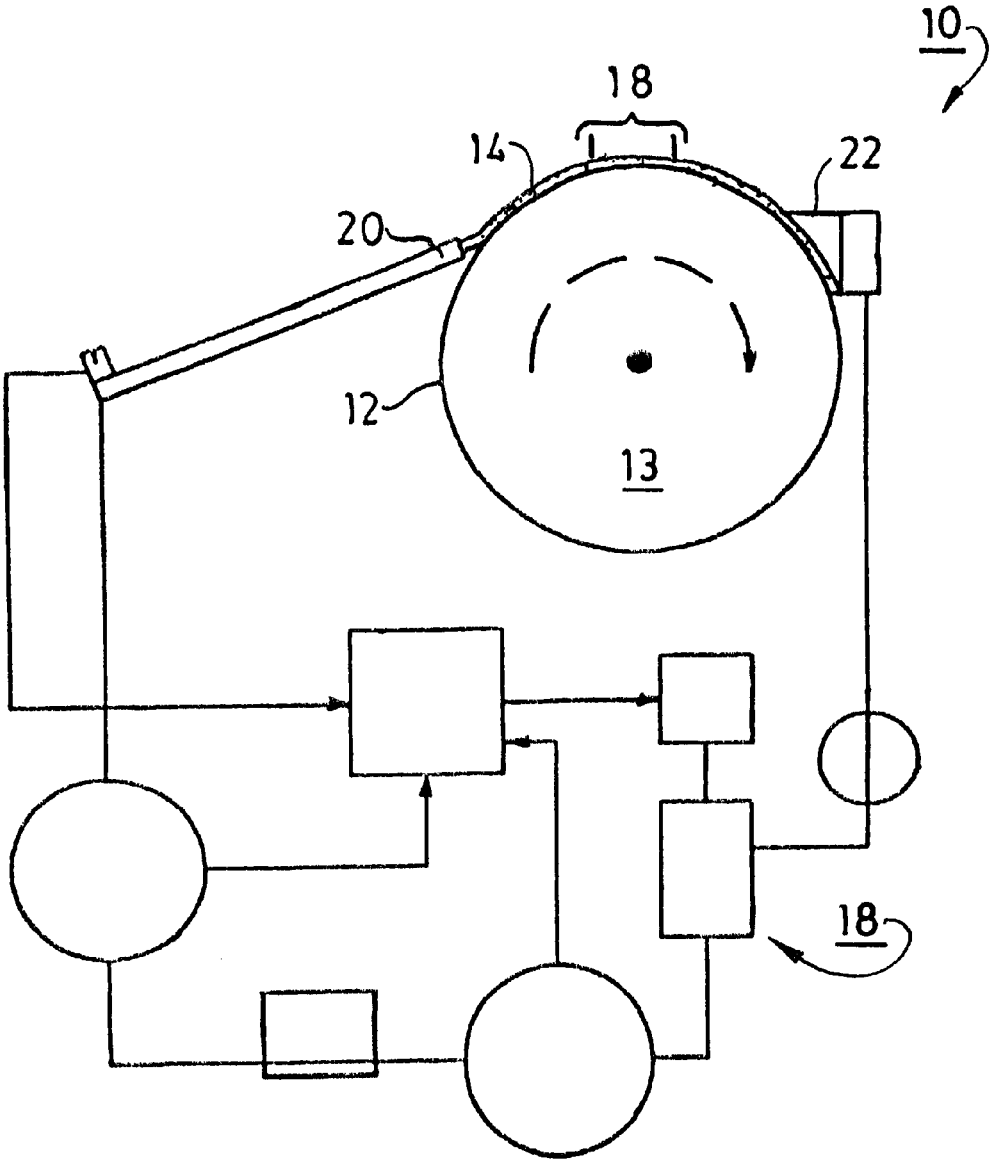
FIG. 1 PRIOR ART

The present invention relates to apparatus for wiping a fluid from a surface, more particularly to apparatus for removing and capturing a liquid being carried on a moving surface, and most particularly to apparatus for removing and capturing a ribbon of magnetorheological fluid from a fluid-conveying surface in a magnetorheological finishing apparatus.

It is known to use abrasive fluids having magnetorheological properties to shape, finish, and polish objects, especially optical elements such as lenses and mirrors. See, for example, U.S. Pat. No. 5,616,066, "Magnetorheological Finishing of Edges of Optical Elements," issued Apr. 1, 1997 to Jacobs et al., U.S. Pat. No. 5,795,212, "Deterministic Magnetorheological Finishing," issued Aug. 18, 1998 to Jacobs et al., and U.S. Pat. No. 5,951,369, "System for Magnetorheological Finishing of Substrates," issued Sep. 14, 1999 to Kordonsky et al. The relevant disclosures of these three patents are hereby incorporated by reference. As used herein, all ablative processes wherein abrasive particles are impinged onto a surface to be ablatively shaped are referred to collectively as "finishing."

A magnetorheological finishing machine, as disclosed in the incorporated references, includes a carrier surface on a rotatable element referred to as a carrier wheel. The carrier surface may reside on an axial face of the carrier wheel, or ore commonly, on the peripheral radial surface of the wheel which typically is a cylindrical section or a spherical section disposed symmetrically about an equatorial plane. The carrier surface presents magnetorheological fluid to a work zone and carries spent fluid away. A magnetorheological finishing machine may further include a fluid handling system for regenerating spent fluid and for metering regenerated fluid to the work zone; a nozzle for dispensing fluid from the fluid handling system onto the carrier surface; and a mechanical scraper in contact with the carrier surface for removing spent fluid from the carrier surface and returning it to the fluid handling system to be regenerated.

In the known art, the contact scraper includes a chamber connected to a fluid return tube and open on the side facing the carrier surface. The sides of the chamber adjacent to the carrier surface are formed to conform generally to the surface, whether planar, cylindrical, or spherical, and are provided with an elastomeric lip which bears resiliently on the carrier surface passing by the chamber and which mechanically scrapes the magnetorheological fluid from the surface into the chamber.

A known art scraper has several serious shortcomings. First, the rubber lip can become worn and reduced in size by the abrasiveness of the magnetorheological fluid. Thus, the lip may need to be replaced frequently, requiring suspension of operations, such replacement being costly in operating time and replacement lips. Second, as the lip wears, the scraper must be advanced toward the carrier surface to maintain necessary contact with the surface and to compensate for lip wear. Such adjustment can be difficult to perform properly during operation of the finishing machine. Thus, the scraper is necessarily complicated in being both adjustable and advanceable. Third, the mechanical scraping action can wear, and thereby deform, the carrier surface, the correct shape of which is highly important to controlling the rate of finishing and the shape of the finishing zone. Particles of elastomer worn from the lip can contaminate the magnetorheological working fluid. Thus, unavoidable wear by the scraper can endanger the quality of finishing and shorten undesirably the working life of the carrier surface.

What is needed is a non-contact means for removing magnetorheological fluid from a carrier surface without mechanically scraping the carrier surface.

It is a principal object of the invention to provide an improved wiper for removing magnetorheological fluid from a carrier surface without mechanical contact between the wiper and the carrier surface.

It is a further object of the invention to provide an improved carrier surface wiper wherein the magnetorheological properties of the fluid are used to assist in removing the fluid from the surface.

It is a further object of the invention to provide an improved carrier surfaced wiper wherein the performance of the wiper is unaffected by the duration of use.

Briefly described, a magnetic wiper for removing magnetorheological fluid from a carrier surface includes a distorted horseshoe magnet having north and south polepieces elongated in width in a first direction orthogonal to a second direction of magnetic flux in the gap between the polepieces. The polepieces are generally parallel at their free ends in the first direction, the first gap therebetween containing a magnetic field, are preferably divergent inwardly of the wiper in the second direction to maximize the field strength at the free ends, and are preferably arcuate such that the concave inner polepiece forms a trough for receiving magnetorheological fluid removed from the carrier surface and conveying it to an exit tube. The free ends are shaped to conform closely to the shape of the carrier surface, forming a second gap between the free ends and the carrier surface, the second gap containing a magnetic fringing field extending beyond the free ends. The first amount of magnetorheological fluid conveyed into proximity with the free ends by the carrier surface is magnetically stiffened to a very stiff paste which is retained in the first and second gaps by the magnetic fields and is thereby prevented from continuing onward with the carrier surface. The stiffened fluid forms a dynamic liquid seal in the gaps such that additional magnetorheological fluid carried towards the magnetic gaps by the carrier surface is wiped and diverted away from the surface and into the trough formed by the inner polepiece. Thus, the magnet forms an effective remover of magnetorheological fluid from the carrier surface without any mechanical scraping contact with the surface. Further, there is no wear of the wiper with use, so that performance of the wiper is unaffected by duration of use.

Figure 2A:
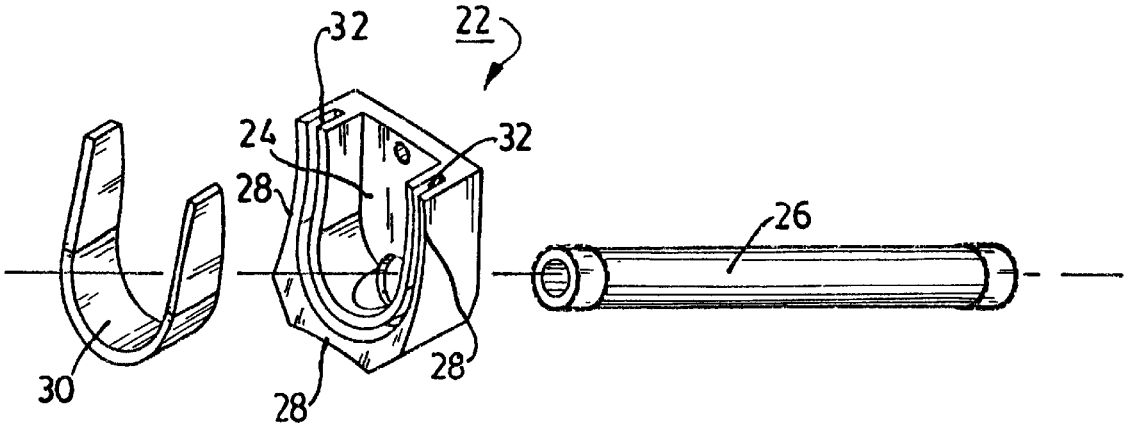
FIG. 2a PRIOR ART
Figure 2B:
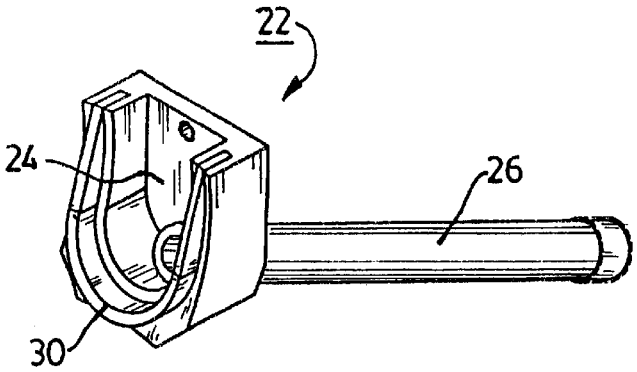
FIG. 2b PRIOR ART

The foregoing and other objects, features, and advantages of the invention, as well as presently preferred embodiments thereof, will become more apparent from a reading of the following description in connection with the accompanying drawings in which:

FIG. 1 is a schematic drawing of a prior art magnetorheological finishing machine, showing the position of a fluid scraper in the fluid flow path;

FIG. 2*a* is an exploded isometric view of a prior art contact scraper;

FIG. 2*b* an isometric assembly of the prior art contact scraper showy in FIG. 2*a;*

Figure 4A:
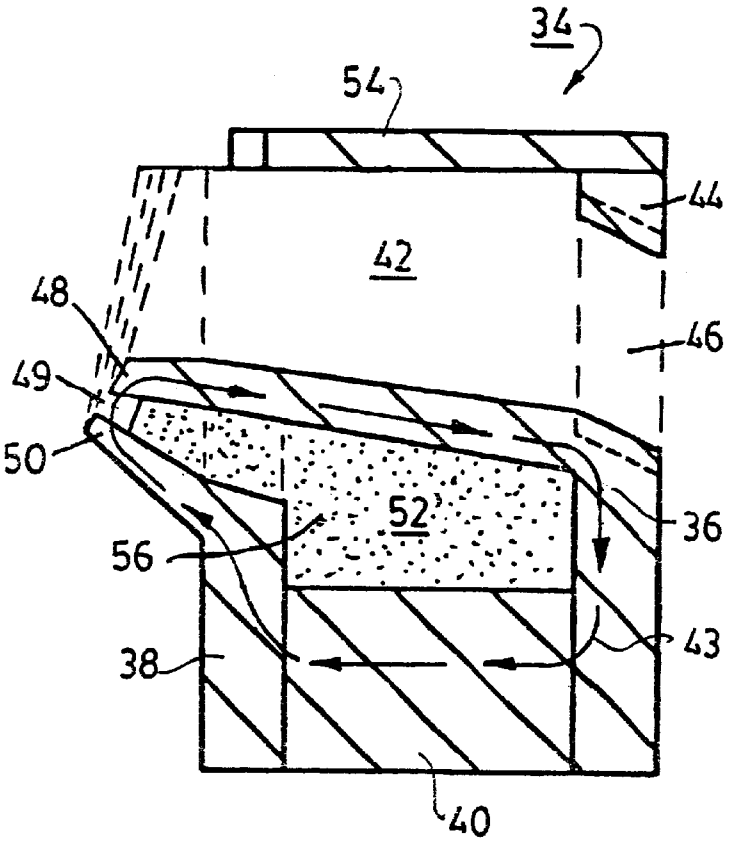
Figure 3:
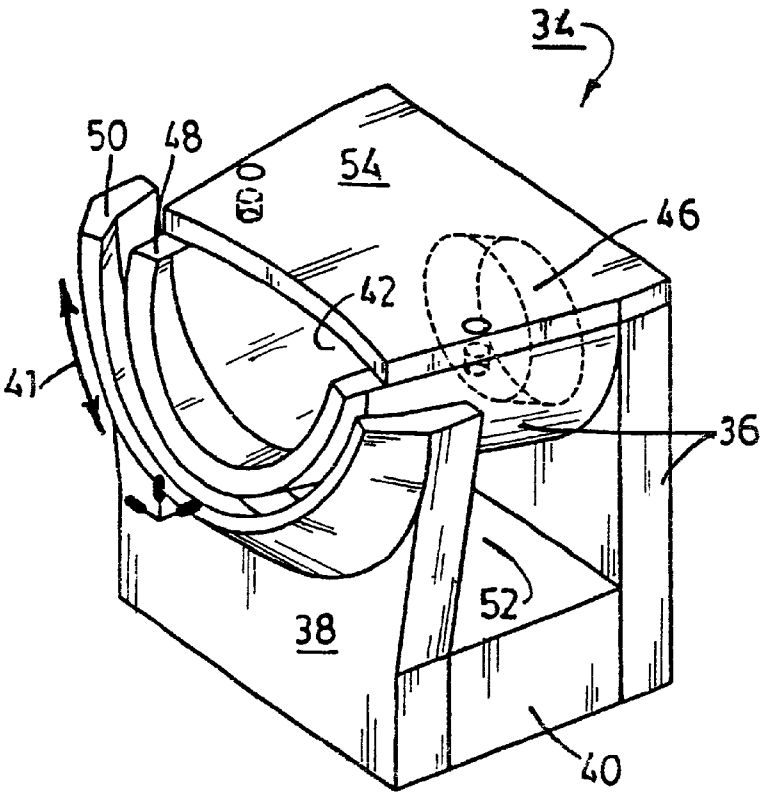
Figure 4C:
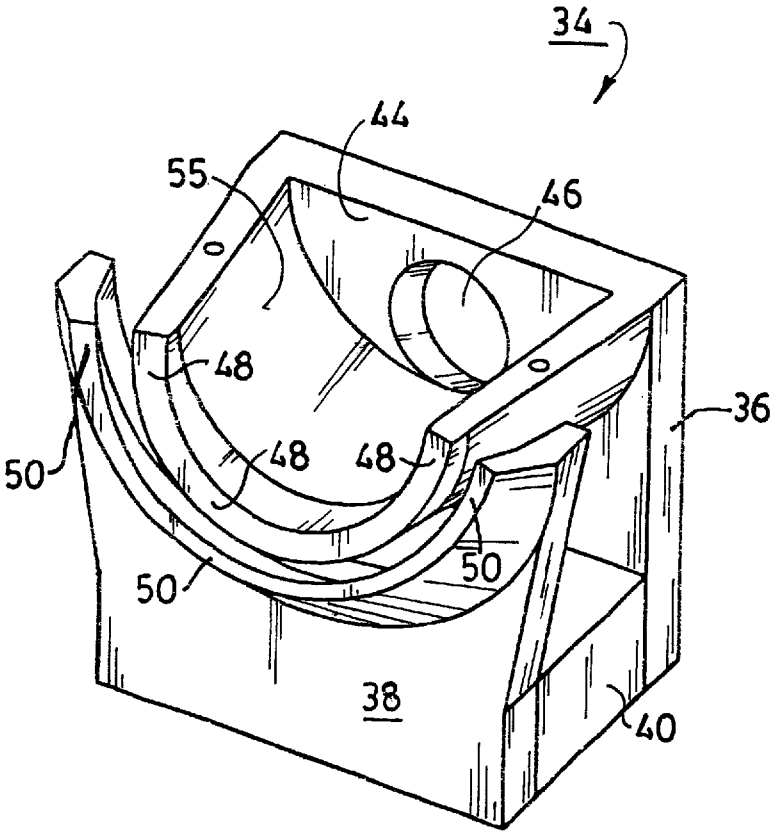
Figure 4B:
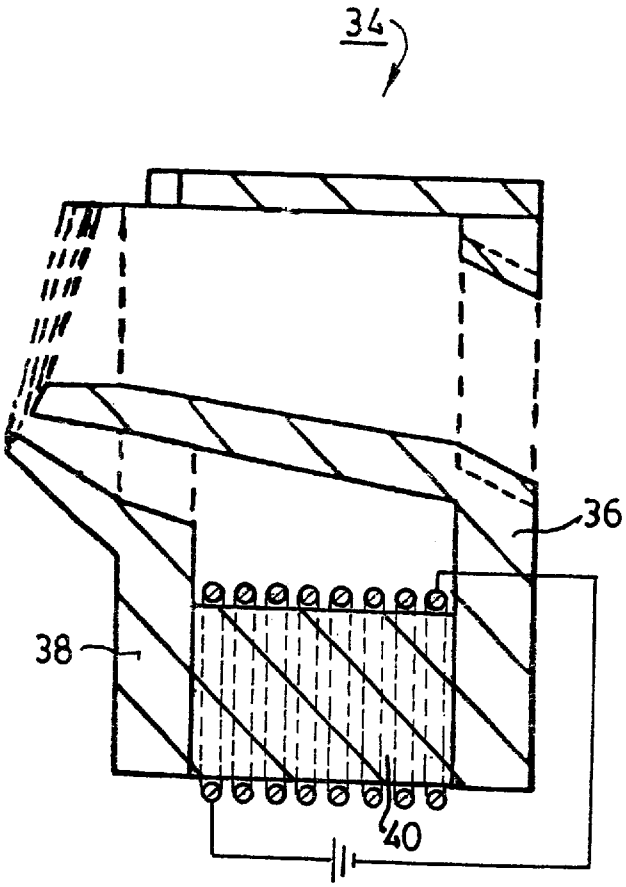
Figure 5:
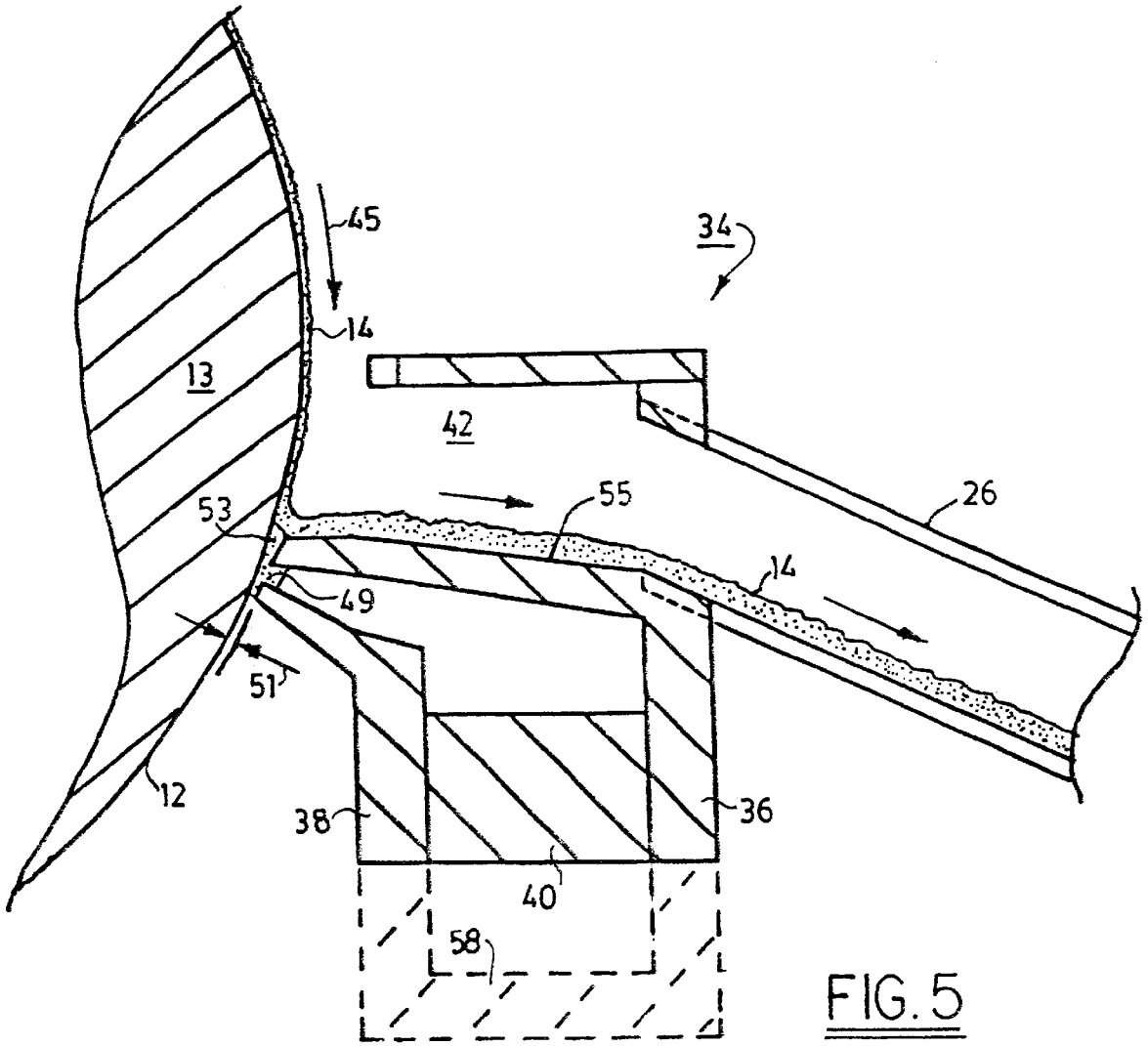
Figure 6B:
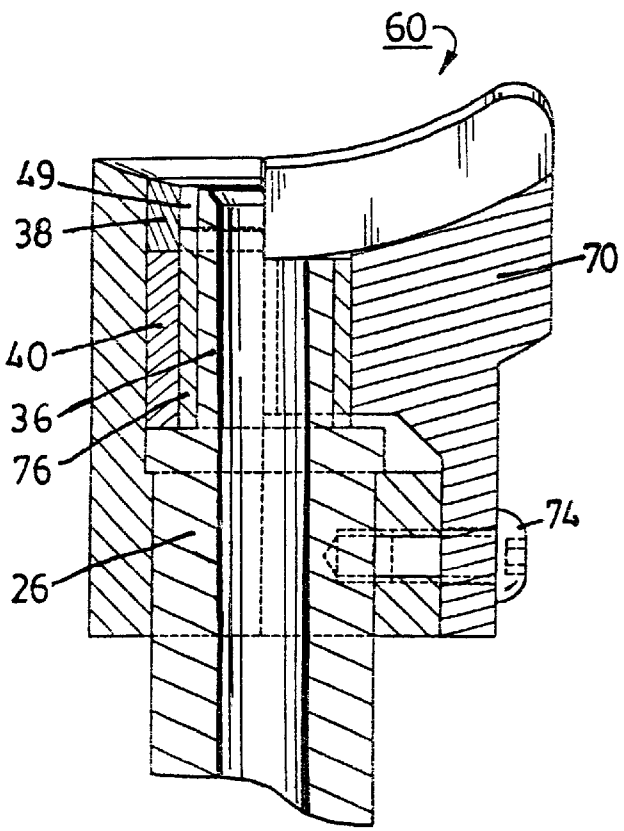
Figure 6A:
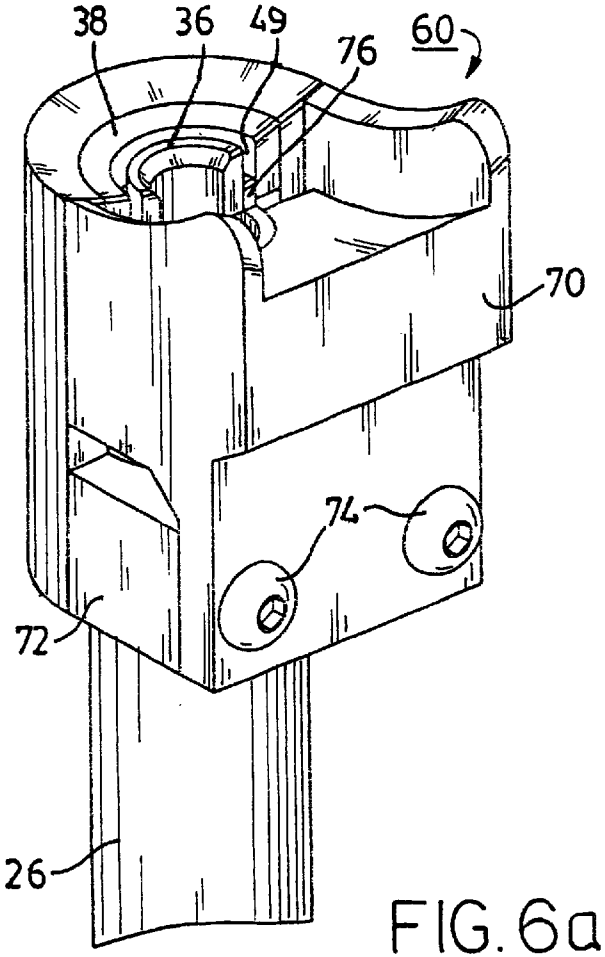

FIG. 3 is an isometric view of a first embodiment of a magnetic wiper in accordance with the invention;

FIG. 4*a* is a cross-sectional view of the wiper shown in FIG. 3, showing use of a permanent magnet;

FIG. 4*b* is a cross-sectional view like that shown in FIG. 4*a*, showing use of an electromagnet;

FIG. 4*c* is an isometric view like that shown in FIG. 3, showing the chamber cover omitted to present more clearly the shape and contours of the magnet pole pieces;

FIG. 5 a cross-sectional view of the novel wiper shown in FIGS. 3–4*b*, showing the wiper in operation in place of a mechanical scraper on a prior art magneto-rheological finishing machine like that shown in FIG. 1;

FIG. 6*a* is an isometric view of a second embodiment of a magnetic wiper in accordance with the invention;

FIG. 6*b* is a cross-sectional view of the magnetic wiper shown in FIG. 6*a;*

Figure 7:
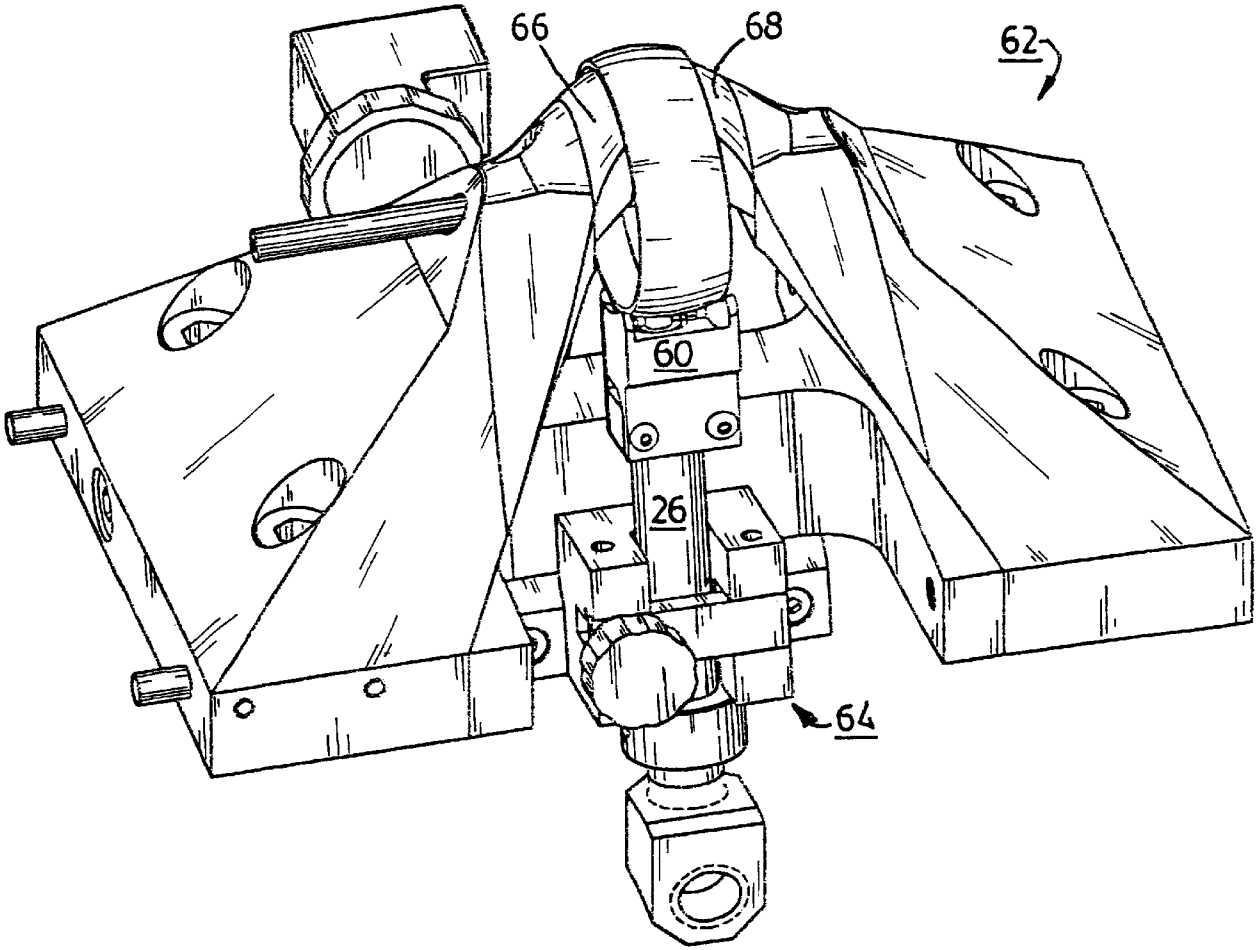
Figure 8:
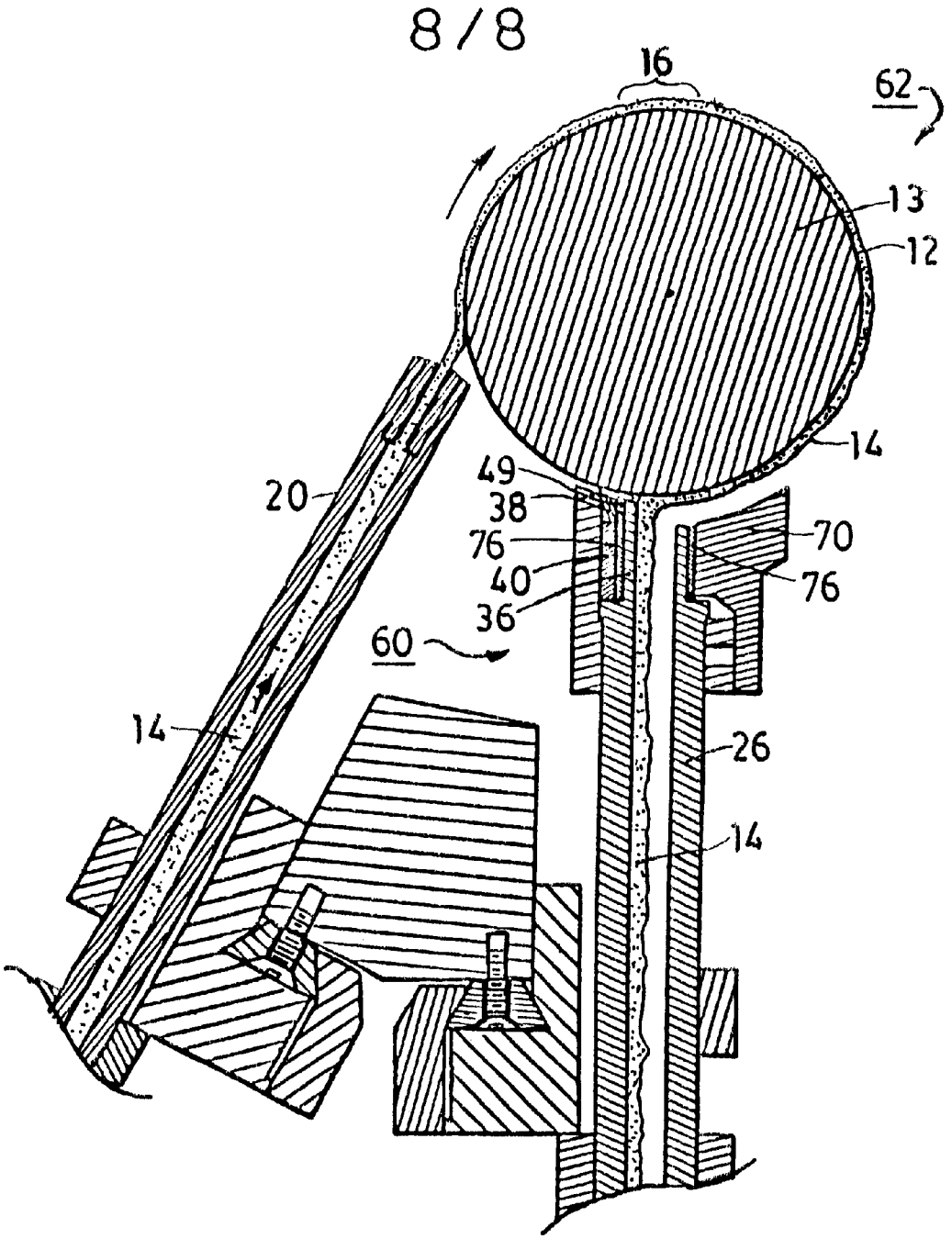

FIG. 7 is an isometric view of a novel magnetorheological finishing apparatus for finishing small-radius concave elements, showing incorporation of the wiper embodiment shown in FIGS. 6*a* and 6*b*; and FIG. 8 is a cross-sectional elevational view of a portion of the apparatus shown in FIG. 7, showing the relationship of the fluid wiper to the carrier wheel.

Referring to FIGS. 1–2*b*, there is shown a generalized schematic of a prior art magnetorheological finishing apparatus substantially as disclosed in U.S. Pat. No. 5,951,369. Apparatus 10 includes a carrier surface 12 on a rotatable carrier wheel 13, typically a cylindrical or spherical section disposed symmetrically about an equatorial plane, for presenting magnetorheological fluid 14 to a work zone 16 on the carrier surface and for carrying the fluid away; further, a fluid handling system 18 for regenerating spent fluid and for metering regenerated fluid to the work zone; further, a nozzle 20 for dispensing fluid from the fluid handling system onto the carrier surface; and further, a mechanical scraper 22 in contact with the carrier surface 12 for removing spent fluid from the carrier surface and returning it to the fluid handling system to be regenerated. Other elements of fluid handling system 18 shown in FIG. 1 are fully disclosed in the incorporated reference and need not be considered further here. Typically, the scraper is disposed at an internal wheel angle of between about 30° and about 90° from the center of the work zone (which is preferably at top dead center position of the wheel, as shown in FIG. 1). To facilitate scraping of the fluid from the carrier surface, it is desirable that the scraper be disposed substantially out of the fringing field created by the work zone magnets.

Contact scraper 22 includes a chamber 24 connected to a fluid return tube 26 and open on the side facing the carrier surface. The sides 28 of the chamber adjacent to the carrier surface are formed to conform generally to the surface, whether planar, cylindrical, or spherical, and are provided with an elastomeric lip 30 which may be removably mounted in a channel 32 in sides 28 and which, in operating position, bears resiliently on the carrier surface 12 passing by the chamber 24 to mechanically scrape the moving ribbon of magnetorheological fluid from the surface into the chamber.

Referring to FIGS. 3–5, a magnetic wiper 34 in accordance with the invention, for substitution in place of scraper 22 as shown in FIG. 1, includes first and second magnetic polepieces, arbitrarily designated as north 36 and south 38, connected to a magnet 40 (permanent, as shown in FIG. 4*a*, or electro, as shown in FIG. 4*b*) to form a distorted horseshoe magnet. Preferably, the polepieces are elongated in width in a first direction 41 orthogonal to a second direction 43 of magnetic flux and are disposed substantially orthogonal to the direction of motion 45 of magnetorheological fluid entering the wiper assembly. Preferably, the polepieces are curved in the first direction as shown in FIGS. 3 and 4*c* such that polepiece 36 forms and defines the bottom 55 of a trough-shaped chamber 42, which trough may be cylindrical and preferably is conical, as shown in FIG. 4*c*, Polepiece 36 further comprises a flange 44 forming a rear wall of chamber 42 having a port 46 therethrough for receiving fluid return tube 26. Polepieces 36 and 38 preferably are configured at the free ends thereof, 48,50 respectively, to have a first gap 49 therebetween and to be closely but non-contactingly conformal to carrier surface 12, a second gap 51 of substantially uniform width being formed between free ends 48,50 nd surface 12. For example, as shown in FIG. 3, free ends 48,50 are substantially spherical-conforming. The outer end of first gap 49 is between about 1 mm and about 4 mm, preferably about 2 mm. Second gap 51 is between about 0.05 mm and about 1 mm, preferably about 0.10 mm.

The volume 52 bounded by polepieces 36,38 and magnet 40 is a void which may conveniently be filled with a non-ferromagnetic filler such as an epoxide filling 56, as shown in FIG. 4*a* (omitted in FIGS. 3, 4*b*, and 4*c*), to prevent collection of debris in void 52. Preferably, the epoxide filling is stopped short of the tips of free ends 48,50 to provide a first gap 49 therebetween. Preferably, the free ends are divergent inwardly in the second direction, as shown in FIG. 4*c*, to maximize the field strength at the free ends and to provide a keystone-shaped cross-section to first gap 49. Chamber 42 may be further provided with a cover plate 54.

Extending from polepiece ends 48,50 is a typical fringing magnetic field which is arcuate in compliance with the configuration of the free ends and which is intense within first gap 49 and second gap 51.

In operation, as the leading edge of a ribbon of magnetorheological fluid 14 being carried on carrier surface 12 reaches first gap 49 and second gap 51, the magnetic field in the gaps causes the leading magnetorheological fluid to respond in known fashion by stiffening into a paste- or clay-like consistency, thereby filling first gap 49 and plugging second gap 51 to form a plug defining a dynamic liquid seal 53 between the magnet and the carrier surface. The plug is locked in place by the keystone shape of gap 49. The magnetic field traps all of the fluid within gaps 49 and 51, allowing none to escape with surface 12, such that surface 12 is effectively wiped clean of fluid and is prepared to continue onward to be recoated with replenished fluid by nozzle 20 as shown in FIG. 1. As carrier wheel 13 continues to turn and thereby to convey additional magnetorheological fluid against seal 53, the additional fluid is diverted away from the carrier surface and flows, either by gravity or by suction, along the upper surface 55 of polepiece 36 through chamber 42 and thence through tube 26. Thus, surface 12 is continuously wiped clean of magnetorheological fluid by wiper 34 without any mechanical contact with surface 12.

At the conclusion of operation, free ends 48,50 may be demagnetized for cleaning either through disconnecting of electromagnet 40 (FIG. 4*a*) or through attachment of a magnetic shunt 58, as shown in FIG. 5.

Referring to FIGS. 6*a* through 8, a second embodiment 60 of a magnetic wiper in accordance with the invention is intended for use at a position about 180° around carrier wheel 13 from work zone 16, as shown in FIG. 8. Magnetorheological finishing machine 62 shown in FIG. 7 is intended for, and optimized for, use in finishing concave elements having a relatively small radius of curvature. It is necessary that the application nozzle 20 and the magnetic wiper 60 be mounted at relatively high angles from the work zone to prevent steric interference with a workpiece being finished at zone 16.

Wiper 60 and its fluid return tube 26 and mounting apparatus 64 fit nicely below wheel 13 in the space between machine magnet polepieces 66,68. However, the operating fringing field from these polepieces can extend into this region, requiring that wiper 60 be provided with ferromagnetic shielding 70 which may be attached to a collar 72 on tube 26 as by bolts 74. In embodiment 60, north polepiece 36 may be integral with tube 26, as shown in FIG. 8. Further, a concentric non-magnetic spacer 76 may be provided between polepieces 36,38 to aid in positioning and aligning the polepieces.

From the foregoing description, it will be apparent that there has been provided an improved non-contact wiper for removing magnetorheological fluid from a carrier surface, wherein the fringing field of a magnet disposed adjacent to the carrier surface stiffens some of the magnetorheological fluid to form a dynamic seal against which additional fluid piles up and may be diverted away from the carrier surface. Variations and modifications of the herein described non-contact wiper, in accordance with the invention, will undoubtedly suggest themselves to those skilled in this art. Accordingly, the foregoing description should be taken as illustrative and not in a limiting sense.

What is claimed is:

1. A magnetic wiper for removing magnetorheological fluid from a carrier surface comprising first and second magnet polepieces off-spaced from said carrier surface to form a gap between said wiper polepieces and said carrier surface, said polepieces being oriented to provide a magnetic field in said gap to stiffen and retain a first amount of said magnetorheological fluid in said gap, said stiffened fluid forming a dynamic liquid seal for preventing the passage of further amounts of said magnetorheological fluid through said gap and for cooperating with said polepieces to divert said further amounts away from said carrier surface.

2. A magnetic wiper in accordance with claim 1 wherein said magnet means is selected from the group consisting of permanent magnet and electromagnet.

3. A magnetic wiper in accordance with claim 2 wherein said first gap is between about 1 mm and about 4 mm.

4. A magnetic wiper in accordance with claim 3 wherein said first gap is about 2 mm.

5. A magnetic wiper in accordance with claim 3 wherein said magnet means is selected from the group consisting of permanent magnet and electromagnet.

6. A magnetic wiper in accordance with claim 2 wherein said second gap is between about 0.05 mm and about 1 mm.

7. A magnetic wiper in accordance with claim 6 wherein said second gap is about 0.10 mm.

8. A magnetic wiper in accordance with claim 1 wherein a space between said polepieces defines a first gap and wherein said gap between said polepieces and said carrier surface defines a second gap and wherein said first amount of magnetorheological fluid is stiffened and retained in both first and second gaps.

9. A magnetic wiper in accordance with claim 1 wherein the shape of said carrier surface is selected from the group consisting of planar, cylindrical, and spherical.

10. A magnetic wiper in accordance with claim 1 wherein said magnet means is disposed essentially transverse to the direction of motion of said magnetorheological fluid on said carrier surface.

11. A magnetic wiper in accordance with claim 1 wherein said magnet means is provided with north and south pole pieces, and wherein at least one of said pole pieces has a cross-sectional shape selected from the group consisting of cylindrical and conical.

12. A magnetic wiper in accordance with claim 1 further disposed in a magnetorheological finishing machine having a wheel-shaped carrier surface, wherein said wiper is disposed at a central angle of said carrier wheel of between about 30° and about 180° from the midpoint of a work zone on said wheel.

13. A magnetic wiper for removing magnetorheological fluid from a carrier surface, the fluid being carried along a path on the carrier surface, the wiper comprising:

a) a magnet spaced apart from said carrier surface to form a gap therebetween and having spaced-apart north and south pole pieces extending transversely of said path to form a magnetic field transversely of said path in said gap for stiffening and retaining a first amount of said magneto-rheological fluid in said gap, said stiffened fluid forming a dynamic liquid seal for preventing the passage of further amounts of said magnetorheological fluid through said gap and for diverting said further amounts away from said carrier surface; and b) a plurality of sidewalls cooperative with said magnet to form a chamber for receiving said magnetorheological fluid diverted away from said carrier surface.

14. A magnetic wiper in accordance with claim 13 further comprising a port in said chamber for passing said diverted magnetorheological fluid out of said chamber.

15. A magnetic wiper in accordance with claim 13 wherein free ends of said north and south pole pieces are substantially parallel to each other.

16. A magnetorheological finishing machine having a carrier surface and having a wiper for removing magnetorheological fluid from said carrier surface, wherein said wiper is provided in accordance with claim 13.

* * * * *